US011703201B2

(12) United States Patent
Kikuchi et al.

(10) Patent No.: US 11,703,201 B2
(45) Date of Patent: Jul. 18, 2023

(54) VEHICULAR LIGHTING TOOL

(71) Applicants: STANLEY ELECTRIC CO., LTD., Tokyo (JP); HONDA MOTOR CO., LTD., Tokyo (JP)

(72) Inventors: Toshiki Kikuchi, Tokyo (JP); Joohyuk Bae, Tokyo (JP); Go Shimizu, Tokyo (JP); Shunichi Nakano, Tokyo (JP); Kenichi Suzuki, Tokyo (JP)

(73) Assignees: STANLEY ELECTRIC CO., LTD., Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/836,491

(22) Filed: Jun. 9, 2022

(65) Prior Publication Data

US 2022/0397252 A1 Dec. 15, 2022

(30) Foreign Application Priority Data

Jun. 14, 2021 (JP) ..... 2021-098878

(51) Int. Cl.
*F21S 41/24* (2018.01)

(52) U.S. Cl.
CPC ..... *F21S 41/24* (2018.01)

(58) Field of Classification Search
CPC ..... B60K 2370/33; F21S 43/14; F21S 8/00; F21S 43/241; F21S 41/43; F21S 43/245; F21S 41/24; F21S 43/237; F21S 43/26; F21Y 2115/10; B60R 1/1207; G02B 6/0038; G02B 6/0018; G02B 6/0035; F21V 5/00

See application file for complete search history.

(56) References Cited

FOREIGN PATENT DOCUMENTS

| | | | |
|---|---|---|---|
| JP | 2010129311 A | * | 6/2010 |
| JP | 6072520 B2 | | 1/2017 |
| JP | 2017126494 A | * | 7/2017 |
| JP | 2020061204 A | * | 4/2020 |

OTHER PUBLICATIONS

Search English translation of JP 2010129311 A (Year: 2010).*
Search English translation of JP 2017126494 A (Year: 2017).*
Search English translation of JP 2020061204 A (Year: 2020).*

* cited by examiner

*Primary Examiner* — Omar Rojas Cadima
(74) *Attorney, Agent, or Firm* — Kenealy Vaidya LLP

(57) ABSTRACT

A vehicular lighting tool of the present invention includes light source and light guide lens, the light guide lens has introduction section into which light is introduced, light distribution section that emits introduced light as illumination light, decoration section that emits introduced light as decoration light, and slit section that separates introduction section and decoration section, and introduction section has light incidence surface into which light from light source enters, lens cut that emits portion of light from light source and that causes portion of light to enter decoration section via slit section, first inclined surface located closer to light distribution section than lens cut, second inclined surface that connects first inclined surface and decoration section, and reflection cut surface provided on surface opposite to slit section and that reflects portion of light entering from light incidence surface so as to advance along second inclined surface.

10 Claims, 5 Drawing Sheets

VEHICULAR LIGHTING TOOL

CROSS-REFERENCE TO RELATED APPLICATION

Priority is claimed on Japanese Patent Application No. 2021-098878, filed Jun. 14, 2021, the content of which is incorporated herein by reference.

BACKGROUND OF THE INVENTION

Field of the Invention

The present invention relates to a vehicular lighting tool.

Description of Related Art

In the related art, in a vehicular lighting tool, there is a technology in which a light distribution section and a decoration section separated with each other by a slit are formed on a light guide lens, and light entering from an incidence surface of the light distribution section is emitted from the light distribution section and the decoration section as different function lights (for example, see Japanese Patent No. 6072520).

SUMMARY OF THE INVENTION

In the above mentioned vehicular lighting tool, when seen from a front side, since a step difference is formed between the decoration section and the light distribution section, there is a problem that a feeling of connection on surfaces of the decoration section and the light distribution section was poor, and appearance during non-lighting is deteriorated. Here, while it is conceivable to adopt a configuration in which the step difference is eliminated by making the surfaces of the decoration section and the light distribution section flush with each other, in this case, since it is necessary to increase a thickness of a light guide lens, brightness unevenness may occur during lighting because it becomes difficult for light to enter a boundary portion between the decoration section and the light distribution section.

An aspect of the present invention provides a vehicular lighting tool capable of reducing brightness unevenness during lighting.

(1) A vehicular lighting tool of an aspect of the present invention includes a light source; and a light guide lens configured to guide light from the light source, the light guide lens has: an introduction section into which light from the light source is introduced; a light distribution section that is connected to the introduction section and that is configured to emit a portion of the light introduced from the introduction section as illumination light; a decoration section that is connected to the light distribution section and that is configured to emit another portion of the light introduced from the introduction section as decoration light; and a slit section configured to separate the introduction section and the decoration section, and the introduction section has: a light incidence surface through which light from the light source enters; a lens cut that is configured to emit a portion of the light from the light source and that causes the portion of the light to enter the decoration section via the slit section; a first inclined surface located closer to the light distribution section than the lens cut; a second inclined surface that connects the first inclined surface and the decoration section; and a reflection cut surface that is provided on a surface opposite to the slit section and that is configured to reflect a portion of the light entering from the light incidence surface so as to advance along the second inclined surface.

(2) In the vehicular lighting tool of the aspect of the above-mentioned (1), an inclination angle of the first inclined surface with respect to an extending direction of the decoration section may be more gradual than an inclination angle of the second inclined surface with respect to the extending direction of the decoration section.

(3) In the vehicular lighting tool of the aspect of the above-mentioned (1) or (2), the introduction section may have a reflection surface that is provided on a surface opposite to the slit section and that is located closer to the light incidence surface than the reflection cut surface.

(4) In the vehicular lighting tool of the aspect of any one of the above-mentioned (1) to (3), at least a part of the reflection cut surface may face the first inclined surface.

(5) In the vehicular lighting tool according to the aspect of any one of the above-mentioned (1) to (4), the introduction section may further have a light emission region that is located between the lens cut and the first inclined surface and that is configured to emit other portion of the light entering from the light incidence surface, and light emitted from the light emission region may pass through the slit section so as to advance along the first inclined surface and enter the light distribution section from the second inclined surface.

(6) In the vehicular lighting tool of the aspect according to any one of the above-mentioned (1) to (5), an optical axis of the light source may be shifted with respect to a center of the light incidence surface of the introduction section toward a tip side of the decoration section.

(7) In the vehicular lighting tool of the aspect according to any one of the above-mentioned (1) to (6), the decoration section may emit the decoration light in an emitting direction of the illumination light in the light distribution section.

(8) In the vehicular lighting tool of the aspect according to any one of the above-mentioned (1) to (7), the light source may include a board, and an emission element provided on a first surface of the board, and the light source may be disposed with respect to the light guide lens so that the first surface of the board is along the extending direction of the light guide lens.

(9) In the vehicular lighting tool of the aspect according to any one of the above-mentioned (1) to (8), light emission surfaces of the light distribution section and the decoration section may be flush with each other.

According to the aspect of the present invention, the vehicular lighting tool is excellent in appearance during non-lighting, and brightness unevenness during lighting can be reduced.

DETAILED DESCRIPTION OF THE INVENTION

Figure 1:
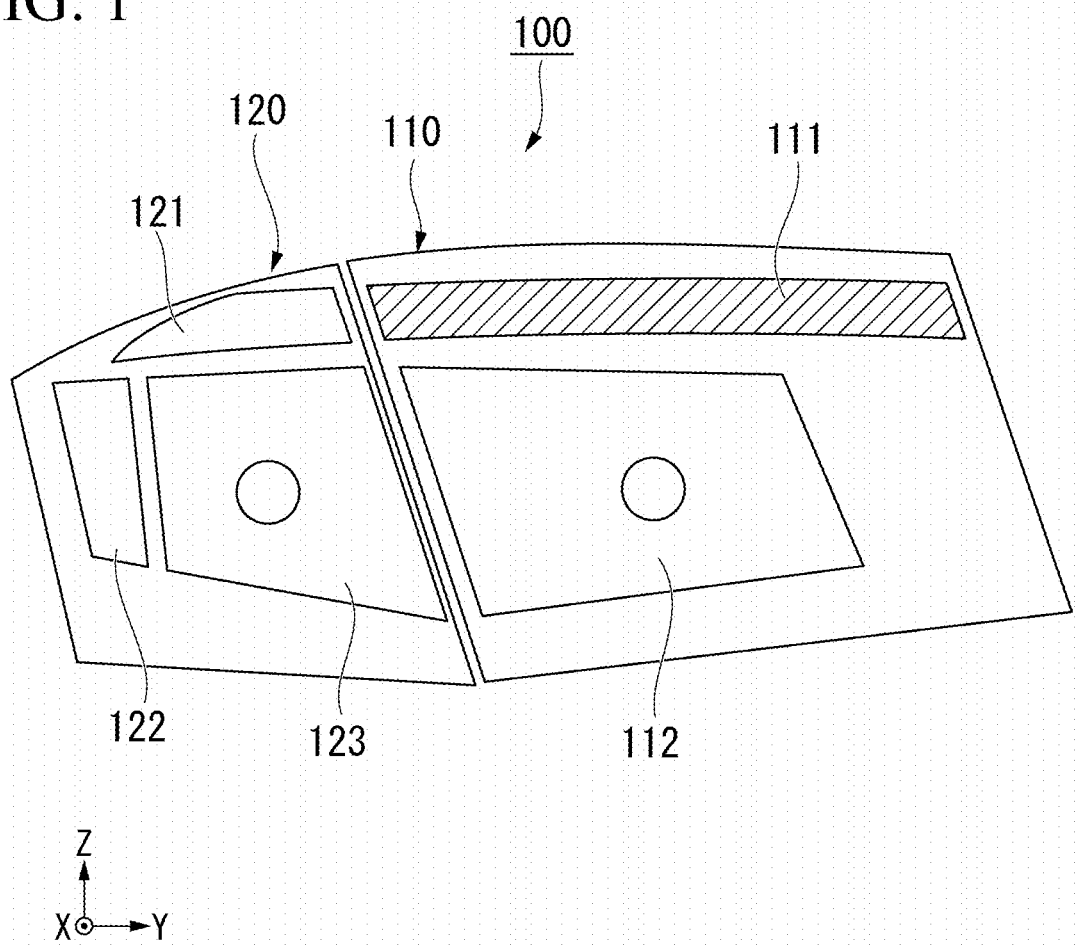
FIG. 1 is a front view showing a schematic configuration of a tail lamp unit to which the present invention is applied.

Hereinafter, an embodiment of the present invention will be described in detail with reference to FIG. 1 to FIG. 6. A vehicular lighting tool of the embodiment is obtained by applying the present invention to a tail lamp of a lid tail lamp that constitutes a tail lamp unit.

Further, in the drawings used in the following description, in order to make each component easier to see, a scale of a dimension may be shown differently depending on the component, and a dimensional ratio or the like of each component may not be the same as the actual one.

In the drawings, an XYZ orthogonal coordinate system is set and a configuration of each member will be described. In addition, in the following description, descriptions of "forward," "rearward," "leftward," "rightward," "upward" and "downward" refer to the respective directions when a tail lamp unit 100 is seen from the back (the rear of the vehicle) unless the context clearly indicates otherwise. Accordingly, the directions when the vehicle is seen from the front (the front of the vehicle) are directions in which forward, rearward, leftward and rightward are reversed.

For example, an X axis corresponds to an axis extending along a forward/rearward direction of a tail lamp unit, a Y axis corresponds to an axis extending along a leftward/rightward direction of the tail lamp unit, and a Z axis corresponds to an axis extending along an upward/downward direction of the tail lamp unit. In the specification, a+X side corresponds to a side in front of the tail lamp unit, a−X side corresponds to a side behind the tail lamp unit, a+Y side corresponds to a right side of the tail lamp unit, a−Y side corresponds to a left side of the tail lamp unit 100, a+Z side corresponds to a side above the tail lamp unit, and a−Z side corresponds to a side below the tail lamp unit. In addition, hereinafter, the directions may be expressed as a forward/rearward direction X, a leftward/rightward direction Y, and an upward/downward direction Z.

FIG. 1 is a front view showing a schematic configuration of the tail lamp unit.

As shown in FIG. 1, the tail lamp unit 100 has a lid tail lamp 110 and a rear combination lamp 120. The lid tail lamp 110 includes a first tail lamp 111 and a back lamp 112. The first tail lamp 111 is disposed to extend along an external form of the lid tail lamp 110. The rear combination lamp 120 includes a second tail lamp 121, a stop lamp 122, and a turn lamp 123. The second tail lamp 121 is disposed to extend along an external form of the rear combination lamp 120.

In the tail lamp unit 100 of the embodiment, the first tail lamp 111 and the second tail lamp 121 are disposed close to each other in the leftward/rightward direction Y to create a lighting appearance with a sense of unity.

Further, the first tail lamp 111 hatched in FIG. 1 corresponds to a vehicular lighting tool of the present invention. Hereinafter, the first tail lamp 111 is simply referred to as "a tail lamp 111."

Figure 2:
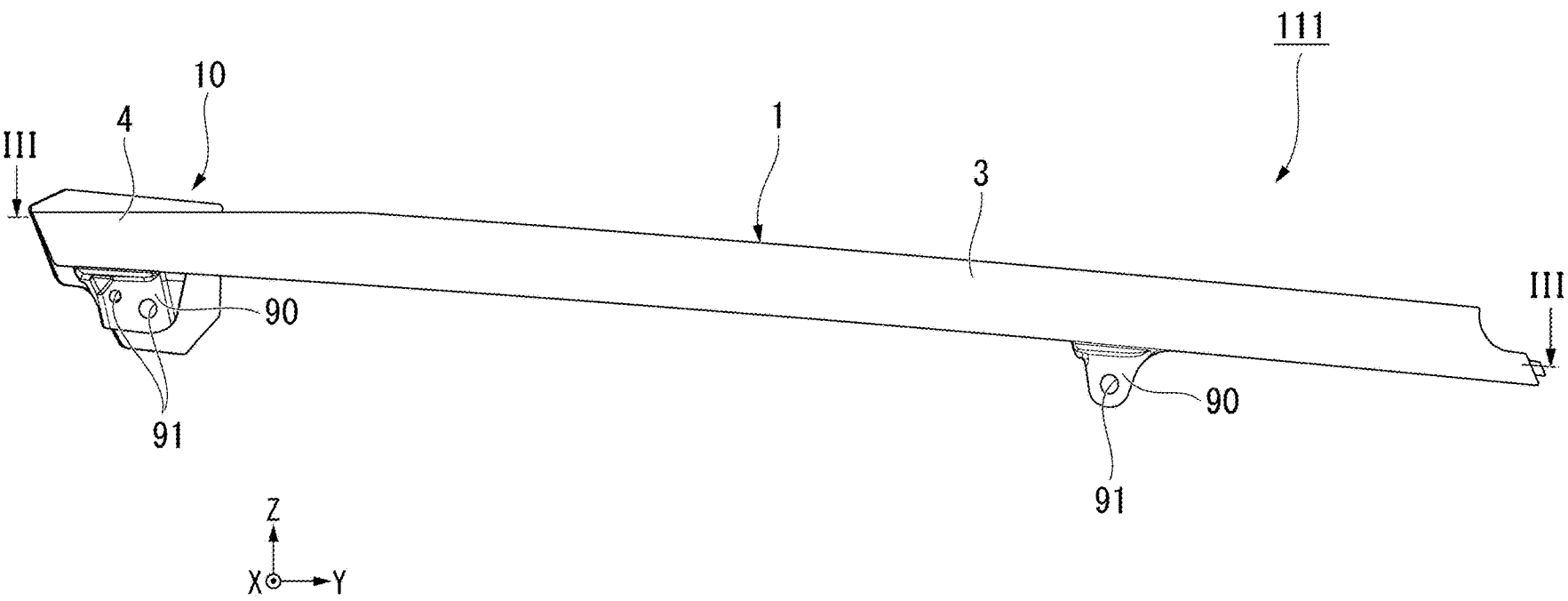
FIG. 2 is a view showing a schematic configuration of a tail lamp according to an embodiment.
Figure 3:
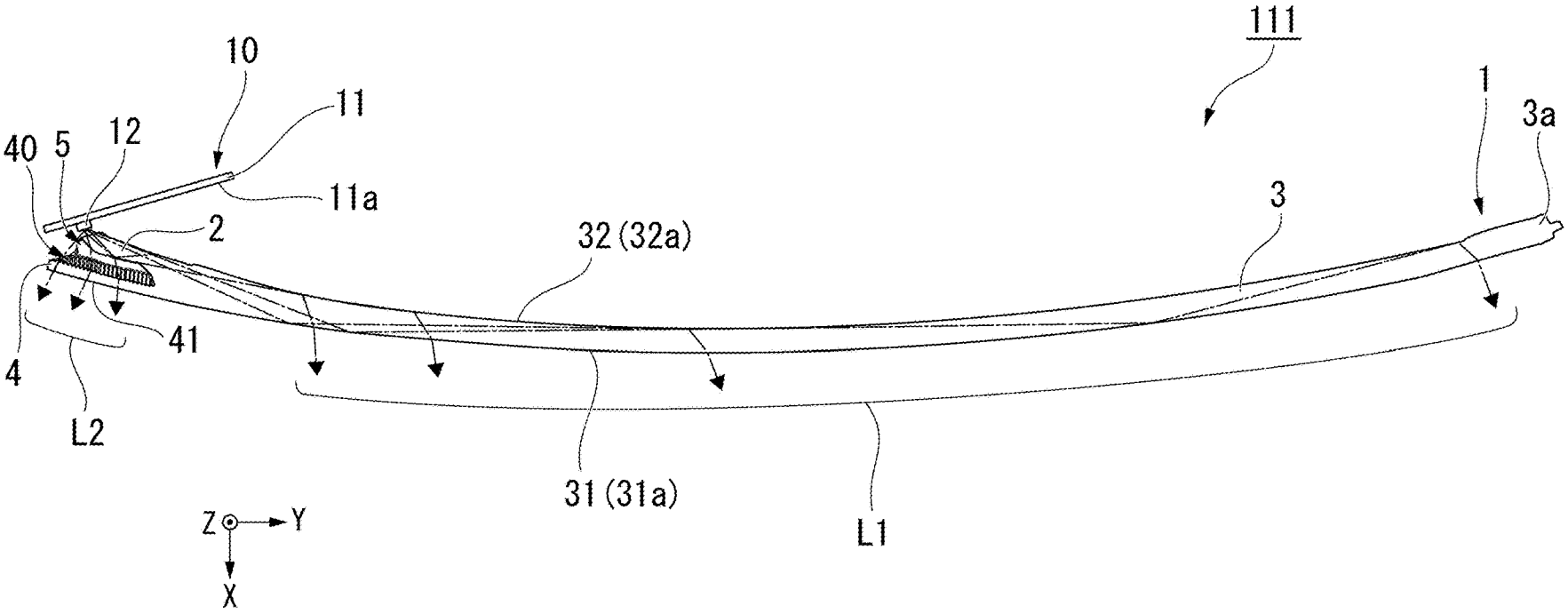
FIG. 3 is a cross-sectional view along an arrow III-III of FIG. 2.
Figure 4:
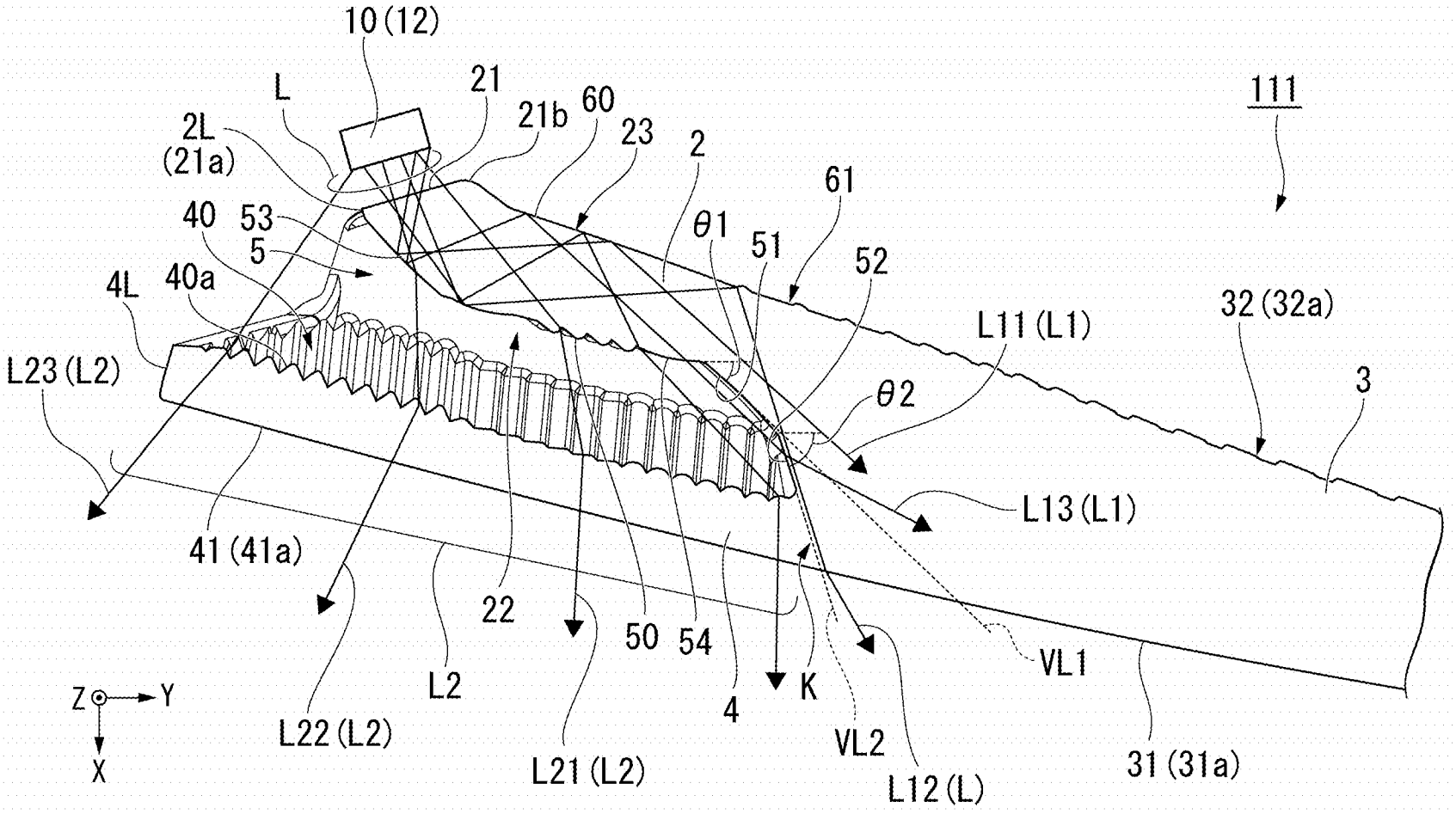
FIG. 4 is a plan view showing a configuration of a major portion of a tail lamp.

FIG. 2 is a front view showing a schematic configuration of the tail lamp 111. FIG. 3 is a cross-sectional view along an arrow III-III of FIG. 2. FIG. 4 is a plan view showing a configuration of a major portion of the tail lamp 111.

As shown in FIG. 2 and FIG. 3, the tail lamp 111 includes a light source 10 and a light guide lens 1. The light source 10 includes a board 11 and an emission element 12. The emission element 12 is provided on a main surface (first surface) 11*a* of the board 11. A driving circuit (not shown) configured to drive the emission element 12 is provided on the main surface 11*a* of the board 11.

The emission element 12 is constituted by a light emitting diode (LED) configured to emit, for example, red light. Further, the number of the emission elements 12 in the light source 10 is not particularly limited and may be singular or plural.

In the embodiment, the light source 10 is disposed with respect to the light guide lens 1 along the main surface 11*a* of the board 11 in the leftward/rightward direction Y that is an extending direction of the light guide lens 1. The light source 10 is held in, for example, a housing (not shown) of the tail lamp unit 100.

As shown in FIG. 2, the light guide lens 1 is attached to the housing (not shown) of the tail lamp unit 100 via an attachment section 90. In the case of the embodiment, the tail lamp 111 is fixed to the housing of the tail lamp unit 100 via the two attachment sections 90 provided in the leftward/rightward direction Y. An opening 91 into which a screw member is inserted is formed in the attachment section 90. Further, a fixing method of the attachment section 90 is not limited to the screw member.

Here, a state in which the main surface 11*a* of the board 11 is provided along the leftward/rightward direction Y is not limited to the case in which the main surface 11*a* and a Y-axis direction are parallel to each other, and may be a state in which the main surface 11*a* and the Y axis are not perpendicular to each other, i.e., a state in which an angle formed between the main surface 11*a* and the Y-axis direction is smaller than at least 90°.

In the embodiment, the light source 10 is located on a left side (−Y side) and a rear side (−X side) of the light guide lens 1. In this way, the tail lamp 111 of the embodiment can minimize an increase in dimension of the tail lamp 111 in the leftward/rightward direction Y in comparison with the case in which the light source 10 is disposed on one end on the light guide lens 1 in the leftward/rightward direction Y such that the main surface 11*a* of the board 11 is perpendicular to the Y axis by disposing the light source 10 behind the light guide lens 1 (−X side).

The light guide lens 1 guides and emits light entering from the light source 10. The light guide lens 1 is formed of a light transmissive member with a high refractive index higher than that of air, for example, a transparent resin such as polycarbonate, acryl, or the like, glass, or the like.

The light guide lens 1 has an introduction section 2, a light distribution section 3, a decoration section 4, and a slit section 5. The slit section 5 is formed from one end (left end) of the light guide lens 1 in the extending direction (the leftward/rightward direction Y) of the light guide lens 1. The slit section 5 separates the introduction section 2 and the decoration section 4.

The introduction section 2 is an area into which light L from the light source 10 is introduced. The introduction section 2 is disposed to face the emission element 12 of the light source 10. The introduction section 2 is located behind the slit section 5 (−X side). The introduction section 2 distributes the light L from the light source 10 to the light distribution section 3 or the decoration section 4. Further, details of the introduction section 2 will be described below.

As shown in FIG. 3, the light distribution section 3 is connected to the introduction section 2, and emits a portion of the light introduced from the introduction section 2 as illumination light L1. The light distribution section 3 has an emitting surface 31 configured to emit the illumination light L1, and a propagation surface 32 configured to reflect the light introduced from the introduction section 2 and propagate the light therethrough.

A plurality of diffusion cuts 31*a* are formed on the emitting surface 31.

The diffusion cuts 31*a* can emit the illumination light L1 in a diffused state. Accordingly, the emitting surface 31 uniformly emits the illumination light L1. Further, examples of the diffusion cuts 31*a* include lens cuts referred to as flute cuts or fisheye cuts, and concavo-convex structures formed by applying knurling, embossing, or the like. In addition, it is possible to control a diffusion degree of the light L emitted from the emitting surface 31 by adjusting a shape or the like of the diffusion cuts 31*a*.

The propagation surface 32 has a reflection structure 32*a* configured to reflect the light L introduced from the introduction section 2 toward the emitting surface 31. The reflection structure 32*a* is configured by cutting a top surface of the propagation surface 32 into a predetermined shape. A portion of the light reflected by the reflection structure 32*a* of the propagation surface 32 enters the emitting surface 31 at a critical angle or less, and is emitted from the emitting surface 31 as the illumination light L1. Meanwhile, another portion of the light reflected by the reflection structure 32*a* of the propagation surface 32 enters the emitting surface 31 at the critical angle or more, and is totally reflected by the emitting surface 31 and propagated toward a tip 3*a* of the light distribution section 3.

On the basis of such a configuration, the light distribution section 3 can guide the light until the tip 3*a* by emitting the light L introduced from the introduction section 2 from the emitting surface 31 and propagating the light between the emitting surface 31 and the propagation surface 32 through total reflection. In this way, the light distribution section 3 emits the illumination light L1 that is emitted uniformly from the entire emitting surface 31 forward (+X direction).

As shown in FIG. 3, the decoration section 4 is connected to the light distribution section 3, and emits the light L entering from the introduction section 2 as decoration light L2. The decoration section 4 is located in front of the slit section 5 (+X side). The decoration section 4 and the introduction section 2 are disposed to face each other with the slit section 5 sandwiched therebetween.

The decoration section 4 has a decoration-side incidence surface 40 that faces the introduction section 2, and a decoration-side emitting surface 41 that emits the decoration light L2. The decoration section 4 emits the decoration light L2 in an emitting direction (+X direction) of the illumination light L1 in the light distribution section 3. The tail lamp 111 of the embodiment emits the illumination light L1 and the decoration light L2 in the same direction (+X direction).

In addition, the tail lamp 111 of the embodiment is formed such the light emission surface of that the decoration section 4 and the light distribution section 3 are flush with each other. Specifically, in the case of the embodiment, the decoration-side emitting surface 41 of the decoration section 4 is flush with the emitting surface 31 of the light distribution section 3.

Here, when the light emission surface of the decoration section 4 is not flush with the light emission surface of the light distribution section 3, i.e., when a step difference portion is provided between the decoration-side emitting surface 41 and the emitting surface 31, during non-lighting, the step difference portion looks dark, which causes a problem that the appearance is degraded.

On the other hand, in the tail lamp 111 of the embodiment, since the step difference portion is not generated between the decoration-side emitting surface 41 and the emitting surface 31 because the light emission surface of the decoration section 4 and the light distribution section 3 are made flush with each other as described above, degradation of appearance during non-lighting is minimized.

As shown in FIG. 4, a tip 4L of the decoration section 4 is located on the left side (−Y side) of a left end 2L of the introduction section 2. For this reason, as shown in FIG. 2, when the light guide lens 1 is seen in a front view, the decoration section 4 is disposed on a back surface side (−X side) of the introduction section 2. For this reason, when seen from the front side, since the introduction section 2 is not seen directly, it is possible to suppress problems such as degradation of appearance during lighting due to the light emitted from the introduction section 2 being visually recognized as brightness unevenness.

An interface of the decoration-side incidence surface 40 is formed by the slit section 5.

In the embodiment, as shown in FIG. 4, the decoration-side incidence surface 40 is a tapered surface in which a slit width in the forward/rearward direction X gradually narrows toward the lower side in the upward/downward direction Z. By making the tapered surface, the light entering the decoration-side incidence surface 40 can be made to refract diagonally to the lower side (−Z side) and the decoration light L2 radiated from the decoration-side emitting surface 41 can be controlled, however, a plane may be made to have a slit width in the forward/rearward direction X which is constant in the upward/downward direction Z. When the slit section 5 is formed to penetrate in the upward/downward direction Z, since a draft angle of a mold is less constrained, it may be constituted by a tapered surface that gradually increases the slit width in the forward/rearward direction X as it goes toward the lower side in the upward/downward direction Z.

A plurality of diffusion cuts 40*a* are provided on the decoration-side incidence surface 40. The plurality of diffusion cuts 40*a* are configured by, for example, arranging prism cuts having a predetermined cross-sectional shape in the extending direction (the leftward/rightward direction Y) of the decoration section 4. The predetermined cross-sectional shape of the embodiment is a triangular shape or a semi-cylindrical shape protruding in the −X direction, and a plurality of prism cuts extending in the upward/downward direction Z are arranged. In the case of the embodiment, the cut shape arranged in the extending direction of the decoration section 4 is not limited one type, and the cut shape is made different for each place of the decoration-side incidence surface 40.

Similarly, a plurality of diffusion cuts 41*a* are formed on the decoration-side emitting surface 41. The plurality of diffusion cuts 41*a* are configured by, for example, arranging prism cuts having a predetermined cross-sectional shape in the upward/downward direction Z. That is, in the case of the embodiment, in the diffusion cuts 40*a* of the decoration-side incidence surface 40 and the diffusion cuts 41*a* of the decoration-side emitting surface 41, directions of the prism cuts are different by 90°.

According to the configuration, since diffusion directions of the light can be made different at the light incidence side and the light emitting side, it is possible to emit the decoration light L2 evenly from the decoration section 4. Further, the cut shape may be different for each place of the decoration-side emitting surface 41 also for the plurality of diffusion cuts 41*a*.

Next, a configuration of the introduction section 2 will be described.

As shown in FIG. 4, the introduction section 2 includes a light incidence surface 21 into which the light from the light source 10 enters, a front surface section 22 connected to one end side (+Y side) of the light incidence surface 21 and facing the slit section 5, and a back surface section 23 connected to the other end side (+Y side) of the light incidence surface 21 and opposite to the front surface section 22. The light incidence surface 21 is provided to face the emission element 12 of the light source 10.

In FIG. 4, illustration is simplified and the board 11 of the light source 10 is omitted. In addition, in FIG. 4, illustration is simplified, and refraction of the light generated on the light incidence surface 21 is omitted.

Further, the light incidence surface 21 of the embodiment is configured as a plane, but may be configured as a curved surface including a lens shape.

An interface of the front surface section 22 of the introduction section 2 is formed by the slit section 5.

A lens cut 50, a first inclined surface 51, a second inclined surface 52, a front surface-side optical surface 53, and a light emission region 54 are provided on the front surface section 22 of the introduction section 2. That is, the introduction section 2 of the embodiment has the lens cut 50, the first inclined surface 51, the second inclined surface 52, and the light emission region 54.

The lens cut 50 emits a portion of the light L from the light source 10, which has entered from the light incidence surface 21, toward the decoration section 4. Hereinafter, the light emitted from the lens cut 50 is referred to as first decoration light L21. A shape of the lens cut 50 is an asymmetrical saw-shaped cut that protrudes forward (+X direction), and apexes or surfaces of the saw-shaped cut are rounded in order to have diffusibility and extends in the upward/downward direction Z that is the same as the prism cut of the decoration-side incidence surface 40. However, it is not necessarily limited to the shape in particular, and may be a knurling form having a semi-cylindrical shape protruding forward (+X direction) or may have a shape having a diffusion function in the leftward/rightward direction Y in which at least the decoration section 4 extends. The reason why the prism cut of the decoration-side incidence surface 40 and the lens cut 50 are formed to extend in the same upward/downward direction Z is that the mold can be easily removed. For example, the decoration-side emitting surface 41 may form a knurling form extending in the leftward/rightward direction Y, and in this case, since light diffuses laterally on the decoration-side incidence surface 40 and diffuses vertically on the decoration-side emitting surface 41, the decoration light L2 irradiated outward can be diffused vertically and laterally to contribute to prevention of brightness unevenness.

The first decoration light L21 emitted from the lens cut 50 enters the decoration section 4 via the slit section 5. Since the first decoration light L21 is emitted while being diffused by the lens cut 50 in the leftward/rightward direction Y, the first decoration light L21 efficiently enters the decoration section 4 within a wide range in the leftward/rightward direction Y.

In this way, the introduction section 2 of the embodiment directly emits a portion of the light L emitted from the light source 10 toward the decoration section 4 from the lens cut 50. That is, since the decoration section 4 of the embodiment generates the decoration light L2 mainly using direct light emitted actively outward from the lens cut 50 of the introduction section 2 (the first decoration light L21) and not the light leaked from the introduction section 2 via the slit section 5 (leak light), it is possible to make the decoration section 4 emit light with the decoration light L2 of sufficient brightness. As a result, in the embodiment, brightness unevenness during emission in the decoration section 4 and the light distribution section 3 is decreased.

The first inclined surface 51 is located closer to the light distribution section 3 than the lens cut 50. The first inclined surface 51 is located on a tip side of the slit section 5. The first inclined surface 51 is a surface inclined in a direction approaching the decoration section 4 toward the tip side of the slit section 5.

The second inclined surface 52 is located on the tip side of the slit section 5 with respect to the first inclined surface 51. The second inclined surface 52 connects the first inclined surface 51 and the decoration section 4 (the decoration-side emitting surface 41). The second inclined surface 52 is a surface inclined in a direction approaching the decoration section 4 toward the tip side of the slit section 5.

Here, an inclination angle of the first inclined surface 51 with respect to the extending direction (the leftward/rightward direction Y) of the decoration section 4 is set as $\theta 1$, and an inclination angle of the second inclined surface 52 with respect to the extending direction (the leftward/rightward direction Y) of the decoration section 4 is set as $\theta 2$.

In the embodiment, the inclination angle $\theta 1$ of the first inclined surface 51 is smaller than the inclination angle $\theta 2$ of the second inclined surface 52. That is, the inclination angle $\theta 1$ of the first inclined surface 51 with respect to the extending direction of the decoration section 4 is more gradual than the inclination angle $\theta 2$ of the second inclined surface 52 with respect to the extending direction of the decoration section 4.

The light emission region 54 emits another portion of the light entering from the light incidence surface 21. While a shape of the light emission region 54 is a curved lens surface protruding forward (+X direction), it is not particularly limited thereto, maybe a triangular lens surface having a more obtuse angle than that of the lens cut or may be a lens surface including a plane or a curved surface. The light emission region 54 is located between the lens cut 50 and the first inclined surface 51. That is, the lens cut 50 and the first inclined surface 51 are separated by an extent of a width of the light emission region 54. For this reason, the first decoration light L21 emitted from the lens cut 50 efficiently enters the decoration section 4 without entering and being reflected by the first inclined surface 51.

The front surface-side optical surface 53 is located on the left side (−Y side) of the lens cut 50, and connects the light incidence surface 21 and the lens cut 50. The front surface-side optical surface 53 has a shape extending forward diagonally to the right from one end 21*a* of the light incidence surface 21 toward the decoration section 4, and then, folded toward the light distribution section 3.

The front surface-side optical surface 53 emits a portion of the light L from the light source 10, which has entered from the light incidence surface 21, toward the decoration section 4. The front surface-side optical surface 53 emits the light entering at an incidence angle smaller than a critical angle toward the decoration section 4 by refracting the light. Hereinafter, a portion of the light L from the light source 10 emitted through the front surface-side optical surface 53 is referred to as second decoration light L22.

Here, in order to make the decoration section 4 emit light uniformly throughout the leftward/rightward direction Y, it is necessary for the second decoration light L22 to efficiently enter until the tip 4L of the decoration section 4. Hereinafter, a position of the light source 10 with respect to the light guide lens 1 to cause the decoration section 4 to emit light evenly will be described.

Figure 5:
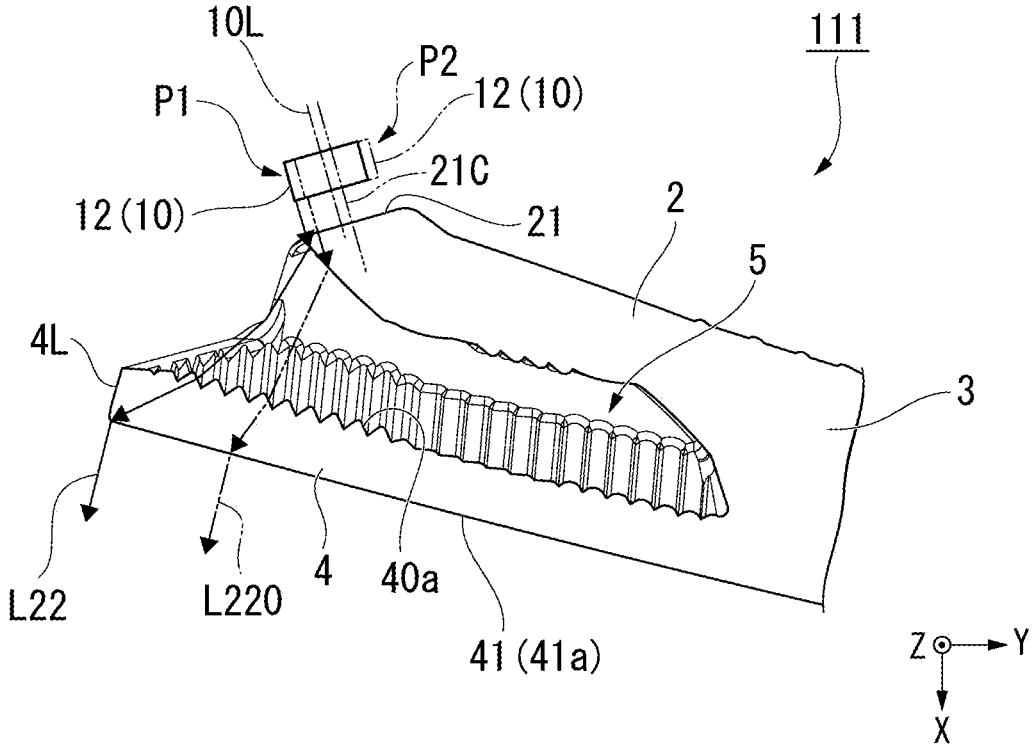
FIG. 5 is a plan view showing a position of a light source with respect to a light guide lens.

FIG. 5 is a plan view showing a position of the light source 10 with respect to the light guide lens 1. Further, in FIG. 5, illustration is simplified and only the emission element 12 of the light source 10 is shown.

As shown in FIG. 5, in the tail lamp 111 of the embodiment, an optical axis 10L of the light source 10 is shifted with respect to a center 21C of the light incidence surface 21 of the introduction section 2 of the light guide lens 1 toward the tip 4L of the decoration section 4. Further, the optical axis 10L of the light source 10 matches with an optical axis of the emission element 12.

As a comparative example, a case in which the light source 10 is disposed with respect to the light guide lens 1 in a state in which the optical axis 10L of the light source 10 matches with the center 21C of the light incidence surface 21 of the introduction section 2 will be described.

In this case, the second decoration light L220 emitted from the left end of the emission element 12 enters the decoration-side incidence surface 40 located on the right side (+Y side) of the tip 4L of the decoration section 4. That is, in the case of the comparative example, since the second decoration light L220 cannot efficiently enter until the tip 4L of the decoration section 4, the decoration section 4 cannot emit light uniformly throughout the leftward/rightward direction Y.

On the other hand, in the case of the embodiment, since the optical axis 10L of the light source 10 is disposed so as to be shifted with respect to the center 21C of the light incidence surface 21 of the introduction section 2 toward the tip 4L of the decoration section 4, the second decoration light L22 can enter the vicinity of the tip 4L of the decoration section 4. That is, in the case of the embodiment, since the second decoration light L22 can efficiently enter until the tip 4L of the decoration section 4, the decoration section 4 can emit light uniformly throughout the leftward/rightward direction Y.

Further, in the case of the embodiment, by shifting the optical axis 10L of the light source 10 with respect to the center 21C of the light incidence surface 21 toward the tip 4L of the decoration section 4, a portion of the light L emitted from the light source 10 can be made to directly enter the decoration-side incidence surface 40 without going through the introduction section 2. Hereinafter, among the light L emitted from the light source 10, an element of the light L that directly enters the decoration-side incidence surface 40 is referred to as third decoration light L23.

Since the decoration section 4 of the embodiment has the diffusion cuts 40*a* and 41*a* formed on both surfaces of the decoration-side incidence surface 40 and the decoration-side emitting surface 41 as described above, the third decoration light L23 directly enters the decoration section 4 from the light source 10 can be sufficiently diffused. Accordingly, even when a portion of the light L emitted from the light source 10 directly enters the decoration section 4, it is possible to minimize occurrence of problems such as a local increase in brightness of the third decoration light L23 emitted from the decoration section 4.

On the basis of such a configuration, as shown in FIG. 4, the decoration section 4 of the embodiment can emit the decoration light L2, which includes the first decoration light L21, the second decoration light L22 and the third decoration light L23, uniformly from the decoration-side emitting surface 41.

Further, in the case of the embodiment, the front surface-side optical surface 53 of the introduction section 2 reflects a portion of the light L from the light source 10 entering from the light incidence surface 21 toward the back surface section 23. The front surface-side optical surface 53 totally reflects the light entering at the incidence angle larger than the critical angle toward the back surface section 23.

Here, a reflection surface 60 and a reflection cut surface 61 are provided on the back surface section 23 of the introduction section 2. That is, the introduction section 2 of the embodiment includes the reflection surface 60 and the reflection cut surface 61 provided on a surface thereof opposite to the slit section 5.

The reflection surface 60 is provided on the surface opposite to the slit section 5 and is located closer to the light incidence surface 21 than the reflection cut surface 61 in the extending direction (the leftward/rightward direction Y) of the introduction section 2. The reflection surface 60 has a shape extending forward diagonally to the right from the other end 21*b* of the light incidence surface 21 toward the decoration section 4, and then, folded toward the light distribution section 3. The reflection surface 60 reflects a portion of the light entered from the light incidence surface 21 and entered from the front surface-side optical surface 53.

As shown in FIG. 4, a portion of the light reflected by the reflection surface 60 (hereinafter, referred to as first reflection light L11) advances inside the introduction section 2 along the first inclined surface 51, enters the light distribution section 3, and is emitted from the emitting surface 31 by being propagated inside the light distribution section 3.

Further, another portion of the light reflected by the reflection surface 60 (hereinafter, referred to as third reflection light L13) is emitted from the light emission region 54 into the slit section 5. The third reflection light L13 emitted from the light emission region 54 passes through the slit section 5 along the first inclined surface 51, enters the light distribution section 3 from the second inclined surface 52, and is emitted from the emitting surface 31 as the illumination light L1 by being propagated inside the light distribution section 3.

According to the tail lamp 111 of the embodiment, the third reflection light L13 emitted from the light emission region 54 to the slit section 5 can enter the light distribution section 3 to be used as the illumination light L1. Accordingly, the light L emitted from the light source 10 can be efficiently used.

Further, while illustration is omitted, there is case in which a portion of the light reflected by the reflection surface 60 enters the lens cut 50 to enter the decoration section 4, and is emitted as the decoration light L2.

As described above, since the first reflection light L11, which is reflected by the reflection surface 60 and enters the light distribution section 3, is light that advances along the first inclined surface 51, the light enters a position which is separated from a boundary portion K between the decoration section 4 and the light distribution section 3.

In the embodiment, as described above, since the decoration-side emitting surface 41 of the decoration section 4 is flush with the emitting surface 31 of the light distribution section 3, the boundary portion K is separated further forward than the introduction section 2. For this reason, since the first reflection light L11 is less likely to enter the boundary portion K, the first reflection light L11 is less likely to be emitted from the boundary portion K to the outside. In this way, when the quantity of light emitted from the boundary portion K to the outside is decreased, during lighting of the tail lamp 111, brightness unevenness may occur because an area corresponding to the boundary portion K becomes relative dark.

On the other hand, in the tail lamp 111 of the embodiment, the reflection cut surface 61 configured to reflect the light from the front surface-side optical surface 53 is provided. The reflection cut surface 61 is provided on a surface opposite to the slit section 5, and reflects a portion of the light, which has entered from the light incidence surface 21 and which enters by being reflected at the front surface-side optical surface 53 (hereinafter, referred to as second reflection light L12), along the second inclined surface 52.

The reflection cut surface 61 is provided such that at least some thereof faces the first inclined surface 51 in the forward/rearward direction X. The reflection cut surface 61 is configured to provide a predetermined cut shape on the surface of the introduction section 2. In the case of the embodiment, the reflection cut surface 61 has the same cut shape as that of the reflection structure 32*a* provided on the propagation surface 32 of the light distribution section 3.

Here, a virtual line extending toward the boundary portion K between the decoration section 4 and the light distribution section 3 along the first inclined surface 51 is referred to as a first virtual line VL1, and a virtual line extending toward the boundary portion K between the decoration section 4 and the light distribution section 3 along the second inclined surface 52 is referred to as a second virtual line VL2.

In the case of the embodiment, the inclination angle θ1 of the first inclined surface 51 with respect to the extending direction of the decoration section 4 is more gradual than the inclination angle θ2 of the second inclined surface 52 with respect to the extending direction of the decoration section 4. For this reason, the second virtual line VL2, which is along the second inclined surface 52, passes closer to the boundary portion K between the decoration section 4 and the light distribution section 3 than the first virtual line VL1, which is along the first inclined surface 51. Accordingly, the second reflection light L12, which is reflected by the reflection cut surface 61 and advancing along the second inclined surface 52, can enter vicinity of the boundary portion K than the first reflection light L11 advancing along the first inclined surface 51. In the embodiment, for example, it is set as θ1=about 40° and θ2=about 70°. Further, while the inclination angles θ1 and θ2 are changed according to the thickness of the light guide lens 1 or the position of the introduction section 2 in the forward/rearward direction X, as long as a relation of θ1<θ2 is maintained, the second reflection light L12 reflected by the reflection cut surface 61 can be guided toward the boundary portion K between the decoration section 4 and the light distribution section 3 along the second inclined surface 52, and brightness unevenness of the boundary portion K can be minimized.

In this way, according to the tail lamp 111 of the embodiment, by reflecting the second reflection light L12 that is a portion of the light entering from the light incidence surface 21 by the reflection cut surface 61 along the second inclined surface 52, it is possible to make the third reflection light L13 to enter the vicinity of the boundary portion K by reflecting the light. Accordingly, the second reflection light L12 can be emitted forward from the light emission surface of a region corresponding to the boundary portion K as some of the illumination light L1. Accordingly, when the tail lamp 111 is lighted, by minimizing reduction in quantity of light emitted from the boundary portion K, it is possible to make the decoration section 4 and the light distribution section 3 emit light evenly as a whole by minimizing occurrence of brightness unevenness as the boundary portion K becomes dark.

In addition, in the tail lamp 111 of the embodiment, since the emission surface of the decoration section 4 is flush with the light emission surface of the light distribution section 3, it is possible to minimize a decrease in appearance during non-lighting.

Accordingly, according to the embodiment, it is possible to provide the tail lamp 111 capable of improving appearance during non-lighting and realizing uniform light emission.

In addition, the tail lamp 111 of the embodiment minimizes an increase in dimension in the leftward/rightward direction Y by disposing the light source 10 behind the light guide lens 1 (−X side). For this reason, according to the tail lamp unit 100 shown in FIG. 1, in the leftward/rightward direction Y, the tail lamp 111 can be disposed in the vicinity of the second tail lamp 121 of the rear combination lamp 120. Accordingly, since darkness in the gap between the second tail lamp 121 and the tail lamp 111 can be reduced, smooth connection can be produced between the second tail lamp 121 and the tail lamp 111 during lighting.

Figure 6:
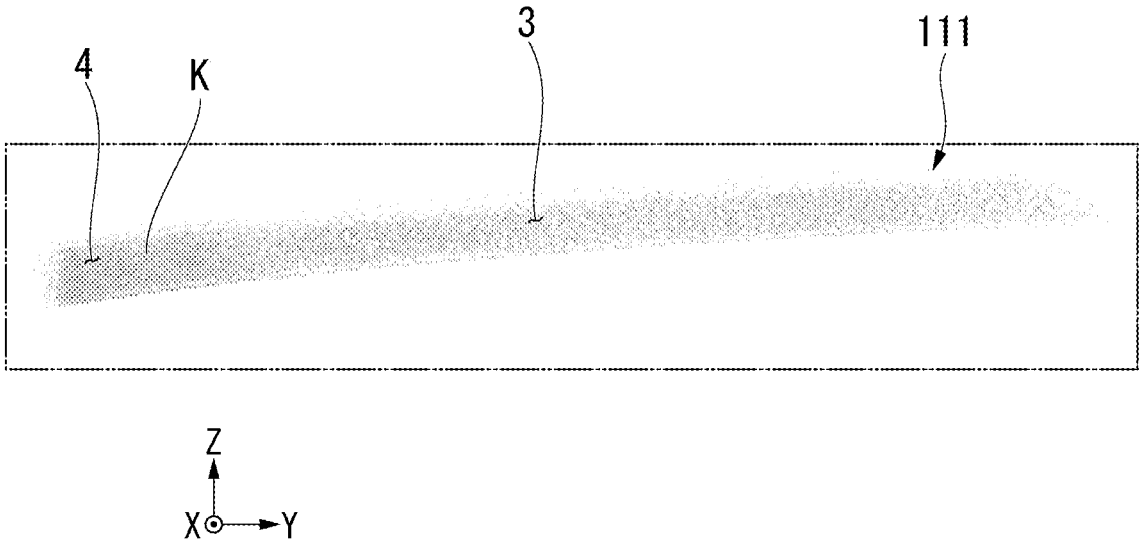
FIG. 6 is a view showing illuminance distribution of the tail lamp.

FIG. 6 is a view showing an illuminance distribution of the tail lamp 111. FIG. 6 shows a simulation result of an illuminance distribution with respect to a virtual screen facing the tail lamp 111.

As shown in FIG. 6, the illuminance distribution of the tail lamp 111 has an illuminance distribution uniform in the leftward/rightward direction Y, in which a decrease in brightness in a portion corresponding to the boundary portion K between the decoration section 4 and the light distribution section 3 is minimized. Accordingly, according to the tail lamp 111 of the embodiment, it is possible to form the illuminance distribution uniform in the leftward/rightward direction Y.

While the embodiment of the present invention has been described as described above, contents of the present invention are not particularly limited to the embodiment, and various modifications may be made without departing from the scope of the present invention.

For example, while the example in which the present invention is applied to the tail lamp 111 mounted on the tail lamp unit 100 has been exemplified in the embodiment, it is not limited to the vehicular lighting tool to which the present invention is applied.

In addition, for example, the vehicular lighting tool of the present invention is appropriate as a vehicular lighting tool used in a place where there is no room for a space on the light entrance side of the light guide lens like a daytime running light (DRL) disposed in the vicinity of a boundary of the head lamp with a grill portion.

In addition, the vehicular lighting tool of the present invention can be widely applied to, for example, a turn lamp, a vehicle width lamp (position lamp), a back lamp, a stop lamp, and the like, in addition to the daytime running light (DRL).

While preferred embodiments of the invention have been described and illustrated above, it should be understood that these are exemplary of the invention and are not to be considered as limiting. Additions, omissions, substitutions, and other modifications can be made without departing from the scope of the present invention. Accordingly, the invention is not to be considered as being limited by the foregoing description, and is only limited by the scope of the appended claims.

What is claimed is:

1. A vehicular lighting tool comprising:

a light source; and a light guide lens configured to guide light from the light source, wherein the light guide lens includes:

an introduction section into which light from the light source is introduced;

a light distribution section that is connected to the introduction section and that includes a light emitting surface which is configured to emit a first light introduced from the introduction section as illumination light;

a decoration section that is connected to the light distribution section and that includes a decoration-side emitting surface which is configured to emit a second light introduced from the introduction section as decoration light; and a boundary portion that is located at a boundary between the light distribution section and the decoration section, and that includes a light emission surface which emits a third light introduced from the introduction section as a light in which occurrence of brightness unevenness has been minimized, a slit section configured to separate the introduction section and the decoration section, and the decoration section includes a decoration-side incidence surface that faces the introduction section and that is located at an emission direction side of the illumination light of the light distribution section, the light emitting surface of the light distribution section and the decoration-side emitting surface are formed to be flush with each other so that a step difference is not generated between (a) the light emitting surface of the light distribution section and (b) the decoration-side emitting surface, and the introduction section includes:

a light incidence surface which inputs light from the light source as light is introduced from the introduction section;

a lens cut that is configured to emit the second light input from the light incidence surface and that causes the second light to enter the decoration-side incidence surface via the slit section;

a first inclined surface that is located closer to the light distribution section than the lens cut and that is located on a tip side of the slit section;

a second inclined surface that connects the first inclined surface and the decoration section and that is located on the tip side of the slit section; and a reflection cut surface that is provided on a surface opposite to the slit section, that is configured to reflect the third light entering from the light incidence surface and to emit from a boundary-side emitting surface, wherein the second inclined surface is formed along a virtual line (VL2) extending toward the light emission surface of the boundary portion from the reflection cut surface.

2. The vehicular lighting tool according to claim 1, wherein an inclination angle of the first inclined surface with respect to an extending direction of the decoration section is more gradual than an inclination angle of the second inclined surface with respect to the extending direction of the decoration section.

3. The vehicular lighting tool according to claim 1, wherein the introduction section has a reflection surface that is provided on a surface opposite to the slit section and that is located closer to the light incidence surface than the reflection cut surface, and the first inclined surface is formed along another virtual line (VL1) extending toward the light emission surface of the boundary portion from the reflection surface and enters the light distribution section which is located separate from the boundary portion.

4. The vehicular lighting tool according to claim 3, wherein at least a part of the reflection cut surface faces the first inclined surface.

5. The vehicular lighting tool according to claim 4, wherein an inclination angle of the first inclined surface with respect to an extending direction of the decoration section is more gradual than an inclination angle of the second inclined surface with respect to the extending direction of the decoration section.

6. The vehicular lighting tool according to claim 1, wherein at least a part of the reflection cut surface faces the first inclined surface.

7. The vehicular lighting tool according to claim 1, wherein the introduction section further has a light emission region that is located between the lens cut and the first inclined surface and that is configured to emit a fourth light entering from the light incidence surface, and the fourth light emitted from the light emission region passes through the slit section so as to advance along the first inclined surface and enters the light distribution section from the second inclined surface.

8. The vehicular lighting tool according to claim 1, wherein an optical axis of the light source is shifted with respect to a center of the light incidence surface of the introduction section toward a tip side of the decoration section so that the introduction section causes a fifth light, which directly enters the decoration-side incidence surface from the light source, to be emitted from the decoration-side emitting surface as a decoration light.

9. The vehicular lighting tool according to claim 1, wherein the decoration section emits the decoration light in the emitting direction of the illumination light in the light distribution section.

10. The vehicular lighting tool according to claim 1, wherein the light source includes a board, and an emission element provided on a first surface of the board, and the light source is disposed with respect to the light guide lens so that the first surface of the board is along the extending direction of the light guide lens.

* * * * *